US007850361B2

(12) United States Patent
Yu

(10) Patent No.: US 7,850,361 B2
(45) Date of Patent: Dec. 14, 2010

(54) REMOVABLE LED LAMP HOLDER

(75) Inventor: Jingjing Yu, El Monte, CA (US)

(73) Assignee: 1 Energy Solutions, Inc., El Monte, CA (US)

( * ) Notice: Subject to any disclaimer, the term of this patent is extended or adjusted under 35 U.S.C. 154(b) by 555 days.

(21) Appl. No.: 12/020,373

(22) Filed: Jan. 25, 2008

(65) Prior Publication Data

US 2009/0027903 A1 Jan. 29, 2009

Related U.S. Application Data

(63) Continuation-in-part of application No. 10/984,651, filed on Nov. 10, 2004, now abandoned.

(51) Int. Cl.
*F21V 33/00* (2006.01)

(52) U.S. Cl. ..... 362/647; 362/652; 362/654

(58) Field of Classification Search ..... 362/640, 362/647, 652–654, 657–659; 439/699.1, 439/699.2, 680
See application file for complete search history.

(56) References Cited

U.S. PATENT DOCUMENTS

| | | | |
|---|---|---|---|
| 1,694,997 | A | 12/1928 | VanHorn |
| 3,519,913 | A | 7/1970 | Janecek |
| 3,593,038 | A | 7/1971 | Hylten-Cavallius et al. |
| 3,639,822 | A | 2/1972 | Brown et al. |
| 3,758,771 | A | 9/1973 | Frohardt et al. |
| 4,035,681 | A | 7/1977 | Savage, Jr. |
| 4,074,165 | A | 2/1978 | Moriyama |
| 4,223,248 | A | 9/1980 | Tong |
| 4,298,869 | A | 11/1981 | Okuno |
| 4,316,125 | A | 2/1982 | Noguchi |
| 4,321,598 | A | 3/1982 | Warner |
| 4,329,625 | A | 5/1982 | Nishizawa et al. |
| 4,348,663 | A | 9/1982 | Yanagishima |
| 4,365,244 | A | 12/1982 | Gillessen et al. |
| 4,367,471 | A | 1/1983 | Gillessen |
| 4,396,823 | A | 8/1983 | Nihei et al. |
| 4,492,952 | A | 1/1985 | Miller |
| 4,521,835 | A | 6/1985 | Meggs et al. |
| 4,528,619 | A | 7/1985 | Dolan et al. |
| 4,595,920 | A | 6/1986 | Runyan |

(Continued)

FOREIGN PATENT DOCUMENTS

| | | |
|---|---|---|
| CA | 2342321 | 3/2000 |

OTHER PUBLICATIONS

U.S. Appl. No. 11/716,788, filed Mar. 12, 2007, by Jing Jing Yu.

(Continued)

*Primary Examiner*—Laura Tso
(74) *Attorney, Agent, or Firm*—William W. Cochran; Cochran Freund & Young LLC

(57) ABSTRACT

Disclosed is an LED lamp assembly that allows an LED lamp to be removably replaced in a lamp holder. A solid, electrical connection is created between the LED pins and electrical terminals as well as connecting wires without soldering. An LED lamp is removably connected to a base that can be inserted in and removed from a socket that is attached to connecting wires. The LED lamp can be removed from the base for replacement of the LED lamp.

6 Claims, 14 Drawing Sheets

U.S. PATENT DOCUMENTS 4,652,981 A 3/1987 Glynn
4,675,575 A 6/1987 Smith et al.
4,727,603 A 3/1988 Howard
4,807,098 A 2/1989 Ahroni
4,839,777 A 6/1989 Janko
4,843,280 A 6/1989 Lumbard
4,857,920 A 8/1989 Kataoka
4,954,822 A 9/1990 Borenstein
4,959,766 A 9/1990 Jain
4,967,330 A 10/1990 Bell et al.
5,087,212 A 2/1992 Hanami
5,130,897 A 7/1992 Kuzma
5,155,669 A 10/1992 Yamuro
5,187,377 A 2/1993 Katoh
5,193,895 A 3/1993 Naruke
5,239,872 A 8/1993 Meyer-Bisch
5,257,020 A 10/1993 Morse
5,313,187 A 5/1994 Choi
5,321,593 A 6/1994 Moates
5,323,305 A 6/1994 Ikeda
5,366,780 A 11/1994 Rapisarda
5,404,282 A 4/1995 Klinke
5,410,458 A 4/1995 Bell
5,436,809 A 7/1995 Brassier
5,457,450 A 10/1995 Deese
5,463,280 A 10/1995 Johnson
5,481,444 A 1/1996 Schultz
5,499,174 A 3/1996 Lin
5,528,484 A 6/1996 Hayashi
5,567,037 A 10/1996 Ferber
5,580,159 A 12/1996 Liu
5,647,759 A 7/1997 Lien
5,649,755 A 7/1997 Rapisarda
5,655,830 A 8/1997 Ruskouski
5,660,560 A 8/1997 Cheng et al.
5,663,719 A 9/1997 Deese
5,670,847 A 9/1997 Lin
5,672,000 A 9/1997 Lin
5,681,107 A 10/1997 Wang
5,720,544 A 2/1998 Shu
5,722,860 A 3/1998 Pan
5,726,535 A 3/1998 Yan
5,762,419 A 6/1998 Yan
5,808,592 A 9/1998 Mizutani
5,887,967 A 3/1999 Chang
5,890,794 A 4/1999 Abtahi et al.
5,936,599 A 8/1999 Raymond
5,941,626 A 8/1999 Yamuro
5,962,971 A 10/1999 Chen
5,988,831 A 11/1999 Pan
6,048,074 A 4/2000 Wang
6,072,280 A 6/2000 Allen
6,079,848 A 6/2000 Ahroni
6,120,312 A 9/2000 Shu
6,183,104 B1 2/2001 Ferrara
6,183,310 B1 2/2001 Shu
6,190,021 B1 2/2001 Huang
6,200,003 B1 3/2001 Tseng
6,227,679 B1 5/2001 Zhang
6,283,797 B1 9/2001 Wu
6,361,198 B1 3/2002 Reed
6,367,952 B1 4/2002 Gibboney
6,461,019 B1 10/2002 Allen
6,478,455 B2 11/2002 Ahroni
6,505,954 B2 1/2003 Chen
6,550,953 B1 4/2003 Ichikawa
D474,848 S 5/2003 Lodhie
6,598,996 B1 7/2003 Lodhie
D485,379 S 1/2004 Steklenbug
6,709,132 B2 3/2004 Ishibashi
6,717,526 B2 4/2004 Martineau et al.
6,739,733 B1 5/2004 Lamke et al.
6,758,578 B1 7/2004 Chou
6,830,358 B2 12/2004 Allen
7,012,379 B1 3/2006 Chambers et al.
7,014,352 B2 3/2006 Wu
7,045,965 B2 5/2006 Li et al.
7,063,442 B2 6/2006 Sugar
7,066,628 B2 6/2006 Allen
7,066,636 B2 6/2006 Wu
7,118,249 B2 10/2006 Hsu et al.
7,217,005 B2 5/2007 Lin
7,220,022 B2 5/2007 Allen et al.
2002/0043943 A1 4/2002 Menzer et al.
2002/0105438 A1 8/2002 Forbes
2003/0025120 A1 2/2003 Chang
2003/0079387 A1 5/2003 Derose
2003/0147245 A1 8/2003 Chen
2003/0198048 A1 10/2003 Frederick
2004/0135522 A1 7/2004 Berman et al.
2004/0140892 A1 7/2004 Hanood
2004/0190289 A1 9/2004 Liu
2004/0190290 A1 9/2004 Zerphy et al.
2004/0233145 A1 11/2004 Chiang
2005/0057187 A1 3/2005 Catalano
2005/0162851 A1 7/2005 Kazar et al.
2006/0007679 A1 1/2006 Allen
2006/0012349 A1 1/2006 Allen
2006/0012997 A1 1/2006 Catalano
2006/0044788 A1 3/2006 Damrau
2006/0098442 A1 5/2006 Yu
2006/0180822 A1 8/2006 Yu
2006/0203482 A1 9/2006 Allen et al.
2006/0270250 A1 11/2006 Allen
2007/0025109 A1 2/2007 Yu
2007/0064450 A1 3/2007 Chiba et al.
2007/0183153 A1 8/2007 Yu
2008/0013324 A1 1/2008 Yu
2008/0024071 A1 1/2008 Yu
2008/0025024 A1 1/2008 Yu
2008/0143234 A1 6/2008 Yu

OTHER PUBLICATIONS

U.S. Appl. No. 11/860,298, filed Sep. 24, 2007, by Jing Jing Yu.
U.S. Appl. No. 60/949,804, filed Jul. 13, 2007, by Jing Jing Yu.
"Holiday Lighting: Latest Technology Saves Time, Money and More," Burrelle's Yeadon Times, Yeadon, PA, Nov. 29, 2001.
"New kind of Christmas lights cut electricity use," Luce Press Clippings, Nevada Appeal, Carson City, NV, Dec. 2, 2001.
www.optics.org, The Online Photonics Resource.
http://ledmuseum.home.att.net/xmas1.htm;www.foreverbright.com.
Christmas may be brighter longer, Huntsville Times, Huntsville, Alabama, Dec. 10, 2001.
"Holiday lights that stay ready for action," News Journal, Wilmington Metropolitan Area, Dec. 17, 2001.
"Bulbs that didn't work spur new line of lights," Richmond, Virginia, Times, Dec. 25, 2001.
"Now, let's eliminate tangles too," Sentinel-Tribune, Bowling Green, Ohio, Dec. 22, 2001.
"LED Christmas lights gaining in popularity," Luce Press, Shamokin, Pennsylvania, Dec. 2, 2001.
"It's beginning to look a lot light Christmas," Luce Press, Democrat, Tallahassee, Florida, Dec. 3, 2001.
"LED lights are Christmas option," Luce Press, Herald News, Joliet, Illinois, Nov. 28, 2001.
"A welcome idea for those who string holiday lights," Luce Press, Times, Seattle, Washington, Nov. 29, 2001.
"LEDing the way," Luce Press, Chronicle, Houston, Texas, Dec. 2, 2001.
". . . malfunctioning yule lights," Desert News, Salt Lake City-Ogden Metro Area, Utah, Dec. 9, 2001.
"LED holiday lights catch on," Luce Press, Herald, Sharon, Pennsylvania, Dec. 2, 2001.

"A brighter day for yule lights," Luce Press, Star, Kansas City, Missouri, Dec. 8, 2001.
"LED Lights Giving Off A Christmas Sparkle," "Entrepreneurs Claim LED Technology Better Than Christmas Bulbs," Luce Press, Tribune, Salt Lake City-Ogden, Utah, Dec. 2, 2001.
"New Christmas lights gaining popularity," Luce Press, Intelligencer, Doylestown, Pennsylvania, Nov. 28, 2001.
"Forever Bright," Luce Press, New Jersey Herald, Newton, New Jersey, Nov. 25, 2001.
"Replacements for traditional Christmas lights gaining popularity," Luce Press, Nov. 28, 2001.
"Inventor lights up Christmas," Luce Press, Valley News Dispatch, Tarentum, Pennsylvania, Nov. 25, 2001.
"The Christmas light man," Luce Press, Dominion Post, Morgantown, West Virginia, Nov. 24, 2001.
"LEDs the coolest thing in holiday lights," Luce Press, Press, Atlantic City, New Jersey, Nov. 25, 2001.
"Consumers switch to LED Christmas lights for their reliability," Luce Press, Star-Gazette, Elmira, New York, Dec. 2, 2001.
"All wrapped up," Luce Press, Ledger, Ellwood City, Pennsylvania, Dec. 1, 2001.
"Beating Christmas burnout," Luce Press, Press Enterprise, Bloomsburg, Pennsylvania, Nov. 26, 2001.
U.S. Appl. No. 09/339,616; Inventor: Tuyet Thi Vo; abandoned.
U.S. Appl. No. 09/378,631, Inventor: Tuyet Thi Vo; abandoned.
Non-final Office Action mailed Feb. 7, 2006 in U.S. Appl. No. 10/984,651, filed Nov. 10, 2004 by Jing Jing Yu.
Non-Final Office Action mailed May 23, 2005, in U.S. Appl. No. 10/767,820, filed Jan. 30, 2004 by Minzhu Li.
Non-Final Office Action mailed Aug. 18, 2008, in U.S. Appl. No. 11/461,293, filed Jul. 31, 2006, by Jing Jing Yu.
Non-Final Office Action mailed May 16, 2008, in U.S. Appl. No. 11/461,293, filed Jul. 31, 2006, by Jing Jing Yu.
Non-Final Office Action mailed Dec. 21, 2007, in U.S. Appl. No. 11/461,293, filed Jul. 31, 2006, by Jing Jing Yu.
Non-Final Office Action mailed Jun. 4, 2007, in U.S. Appl. No. 11/189,066, filed Jul. 26, 2005, by Jing Jing Yu.
Non-Final Office Action mailed Oct. 27, 2008, in U.S. Appl. No. 11/849,939, filed Sep. 4, 2007, by Jing Jing Yu.
Final Office Action mailed Sep. 25, 2008, in U.S. Appl. No. 11/849,939, filed Sep. 4, 2007, by Jing Jing Yu.
Non-Final Office Action mailed Mar. 20, 2008, in U.S. Appl. No. 11/849,939, filed Sep. 4, 2007, by Jing Jing Yu.
Non-Final Office Action mailed Jun. 14, 2007, in U.S. Appl. No. 11/350,343, filed Feb. 9, 2006, by Jing Jing Yu.
Non-Final Office Action mailed Feb. 15, 2007, in U.S. Appl. No. 11/056,148, filed Feb. 14, 2005, by Jing Jing Yu.
Non-Final Office Action mailed Jun. 14, 2007, in U.S. Appl. No. 11/350,343, filed Feb. 9, 2006, by Jing Jing Yu.

REMOVABLE LED LAMP HOLDER

CROSS-REFERENCE TO RELATED APPLICATION

This application is a continuation-in-part of U.S. patent application Ser. No. 10/984,651, entitled "Removable LED Lampholder," by Jing Jing Yu, filed Nov. 10, 2004. The entire contents of the above mentioned application are hereby specifically incorporated herein by reference for all that it discloses and teaches.

BACKGROUND OF THE INVENTION

Incandescent lights work in a full cycle of sinusoid AC voltage, so there is no concern about their polarities when connecting them to either a DC or an AC power line. An LED light, however, being a diode, conducts current only in one direction, i.e. from its anode side to cathode side. To work properly, an LED light must be connected with a right polarity in a DC power line, where a positive voltage must be applied from anode to its cathode. When an LED is used in an AC circuit, it conducts current only for half cycle of the AC voltage, i.e. only when the AC voltage has a positive voltage offset from the LED anode pin to the LED cathode pin.

When two or more LEDs are connected in series, all LEDs must be connected in a same polarity direction, i.e. the anode of the second LED must be connected to the cathode of the first LED, and the anode of the third LED must be connected to the cathode of the second LED, and so on. Otherwise, no current can flow through the series circuit, if one or more LEDs are connected in an opposite polarity direction with respect to the rest LEDs.

SUMMARY OF THE INVENTION

An embodiment of the present invention may therefore comprise an LED lamp assembly for releasably attaching an LED lamp to a power connection comprising: an LED lamp comprising: a rounded upper body lamp portion; a cylindrical lamp base; an anode pin and a cathode pin extending from the cylindrical lamp base; a base comprising a lower body connected to the cylindrical upper body, the lower body having a first opening formed in the lower body through which the anode pin protrudes and wraps around a first surface of the lower body, and a second opening formed in the lower body through which cathode pin protrudes and wraps around a second surface of the lower body; a socket comprising a socket body base formed to provide a socket body opening with two semicircular grooves formed in a first wall of the socket body opening, and one semicircular groove formed in a second wall, a first set of slots disposed adjacent to the first wall of the socket body opening that extend a portion of a length of the socket body base, and a second set of slots disposed adjacent to the second wall of the socket body opening that extend a portion of a length of the socket body base; an anode terminal plate disposed in the first set of slots that contacts the anode pin that is sandwiched between the anode terminal plate and the surface of the lower body, so that an electrical contact is formed between the anode terminal plate and the anode pin without soldering the anode pin to the anode terminal plate; a cathode terminal plate disposed in the second set of slots that contacts the cathode pin that is sandwiched between the cathode terminal plate and the second surface of the lower body, so that an electrical contact is formed between the cathode terminal plate and the cathode pin without attaching the cathode pin to the terminal plate; a first pair of wires sandwiched between the two semicircular grooves formed in the first wall and the anode terminal plate, the wires having a size that is sufficient to create a force on the anode terminal plate towards the anode terminal plate towards the anode pin, and the anode pin and the lower body having a size sufficient to create a force on the anode terminal plate towards the wires so that the pair of wires and the anode pin are securely physically held against the anode terminal plate to create a solid electrical connection of the first pair of wires and the anode pin to the anode plate without soldering the wires and the anode pin to the anode plate while allowing the lower body portion to be removed from the socket; a third wire sandwiched between the semicircular groove formed in the second wall and the cathode terminal plate, the third wire having a size that is sufficiently large to create a force on the cathode terminal plate towards the cathode pin, and the cathode pin and the lower body having a size sufficient to create a force on the cathode terminal plate towards the third wire so that the third wire and the cathode pin are securely physically held against the cathode terminal plate to create a solid electrical connection of the third wire and the cathode pin to the cathode plate without soldering the third wire and the cathode pin to the cathode plate while allowing the lower body portion to be removed from the socket; a wedge plug having two semicircular grooves formed in a first wall of the wedge plug and one semicircular groove formed in a second wall of the wedge plug so that when the wedge plug is inserted in the socket body base, the two semicircular grooves formed in the wedge plug are aligned with the two semicircular grooves formed in the socket body base to form two circular openings, and the one semicircular groove formed in the wedge plug is aligned with the one semicircular groove formed in the socket body base to form one circular opening, the two circular openings having a size that locks and seals the first pair of wires in the socket body base, and the one circular opening having a size that locks and seals the third wire in the socket body base.

An embodiment of the present invention may therefore further comprise a method of releasably connecting an LED lamp to an AC power string and to other LED lamps comprising: providing a lamp holder comprising a base, a socket body, an anode terminal plate, a cathode terminal plate and a wedge plug; providing an LED lamp that has a cylindrical lamp base, an anode pin and a cathode pin; inserting the LED lamp into the base of the lamp holder to form a seal between the base and the LED lamp; inserting the anode pin and the cathode pin through openings in the base; wrapping the anode pin around a first surface of the base so that the anode pin can be removed from the base to replace the LED lamp; wrapping the cathode pin around a second surface of the base so that the cathode pin can be removed from the base to replace the LED lamp; inserting a first pair of wires in first and second semicircular grooves in the socket body of the lamp holder; inserting the anode terminal plate into a first set of slots adjacent to the first and second semicircular grooves so that the first pair of wires are sandwiches between the first and second semicircular grooves and the anode terminal plate which creates an inward force on the anode terminal plates; inserting a third wire in a third semicircular groove in the socket body of the lamp holder; inserting the cathode terminal plate into a second set of slots adjacent to the third semicircular groove so that the third wire is sandwiched between the third semicircular groove and the cathode terminal plate which creates an inward force on the cathode terminal plate; inserting the base and the anode pin into the socket body, the socket body having a size that creates an outward force from the first surface of the base towards the anode terminal plate and from the second surface of the base towards the cathode terminal plate so that the anode pin and the first pair of wires are securely physically held against the anode terminal plate to create a strong electrical connection while allowing the base and the anode pin to be removed from the socket body, and the cathode pin and the third wire are securely physically held against the cathode terminal plate to create a strong electrical connection while allowing the base and the cathode pin to be removed from the socket body; inserting a wedge plug in the socket body, the wedge plug having semicircular grooves that are aligned with the first, second and third semicircular grooves in the socket body to form circular openings that have a size that locks and seals the wires to the socket body.

DETAILED DESCRIPTION OF EMBODIMENTS OF THE EMBODIMENTS

Figure 1:
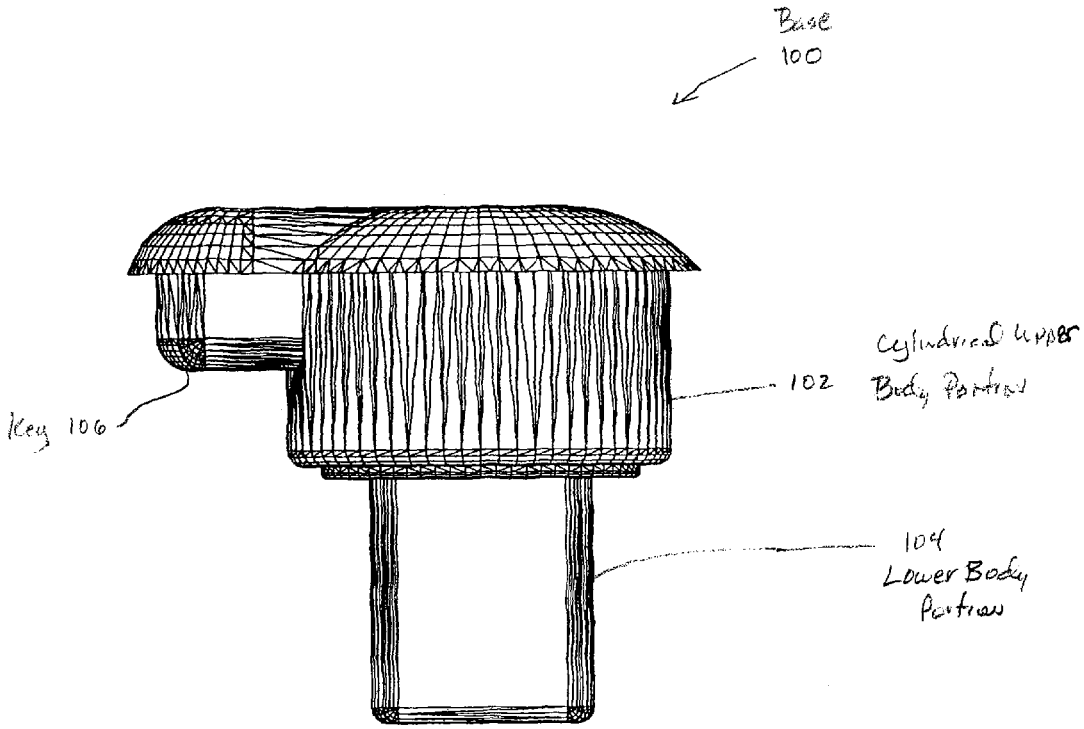
FIG. 1 is a side view of one embodiment of a base of an LED lamp holder.

FIG. 1 is a side view of a base 100 of an LED lamp holder. The base 100 comprises a cylindrical upper body portion 102, a lower body portion 104 and a key 106. Key 106 provides an orientation for the cylindrical upper body portion 102 and the lower body portion 104. Since LED lamps have a polarity that must be maintained with respect to connection of the LED lamp to power supplies and other LEDs, a key 106 is needed to ensure that the LED lamp is connected in the proper orientation to the LED lamp holder and to make sure that the LED lamp holders are connected to one another with the proper orientation.

Figure 2:
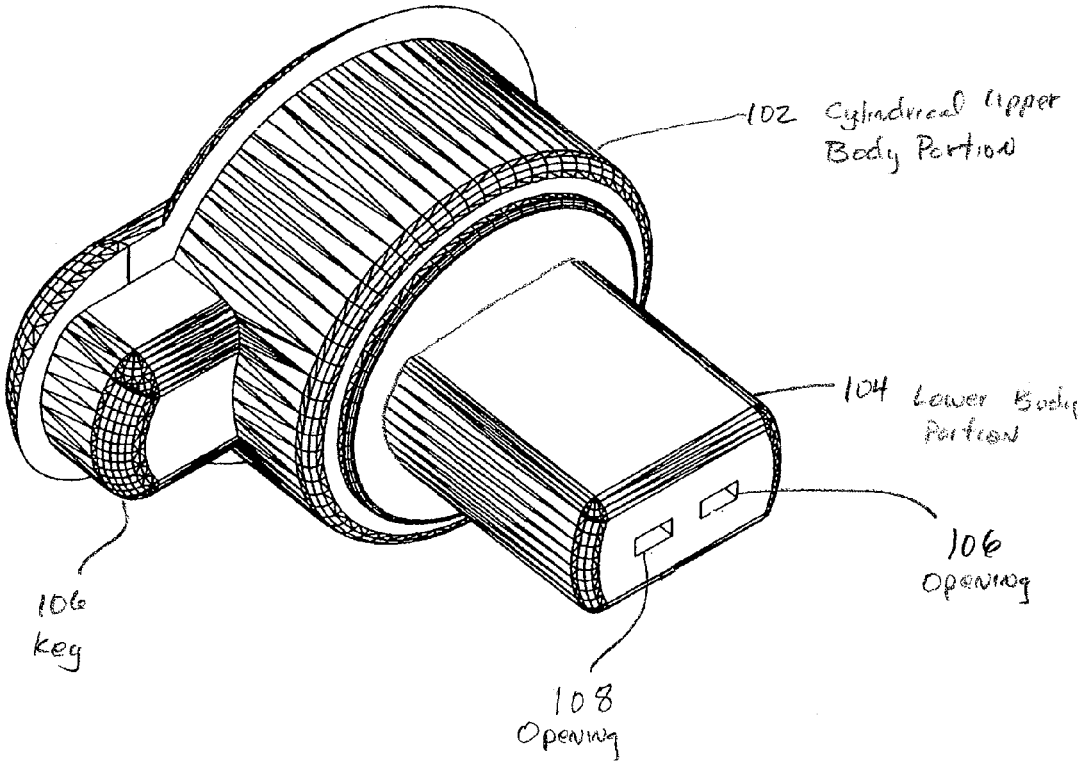
FIG. 2 is a schematic bottom side view of the base illustrated in FIG. 1.

FIG. 2 is a bottom isometric view of the base 100 illustrated in FIG. 1. FIG. 2 illustrates the cylindrical upper body portion 102 and the key 106. As also shown in FIG. 2, the lower body portion 104 has two openings, openings 106 and opening 108. Opening 106 and opening 108 allow the LED cathode pin 504 (FIG. 5) and the LED anode pin 506 (FIG. 5), respectively, to protrude through the bottom of the lower body portion 104. The LED anode pin 506 (FIG. 5) protrudes through opening 108, which is aligned with key 106. Cathode pin 504 (FIG. 5) protrudes through opening 106 when the LED lamp 500 (FIG. 5) is assembled to the base 100, as illustrated in FIG. 6.

Figure 3:
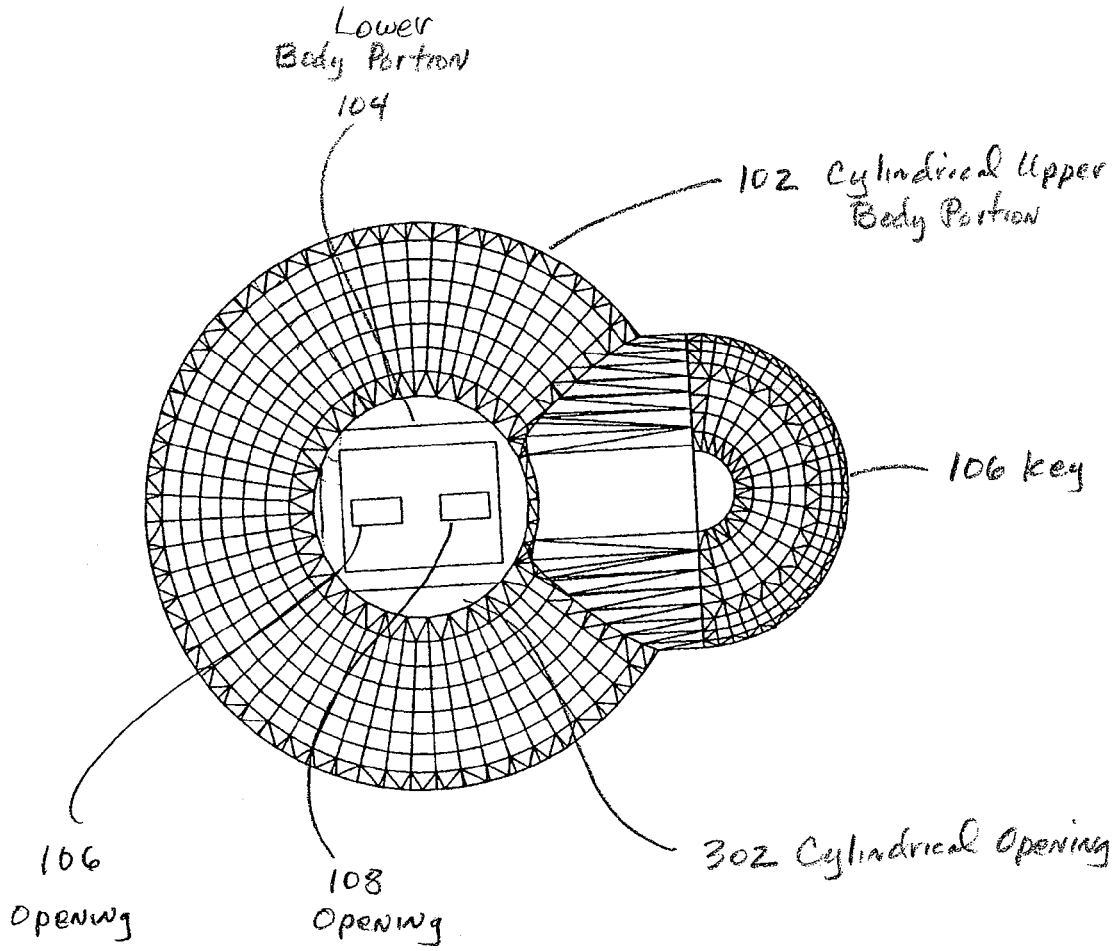
FIG. 3 is a bottom view of the base illustrated in FIG. 1.
Figure 4:
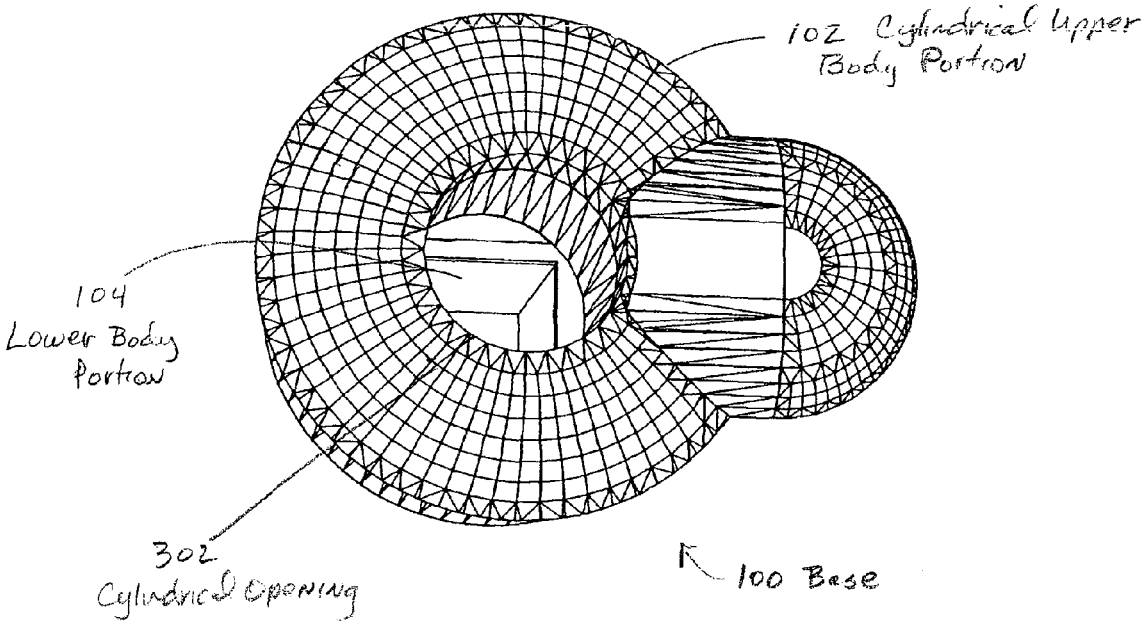
FIG. 4 is a top side view of the base illustrated in FIG. 1.

FIG. 3 is a top view of the base 100 illustrated in FIGS. 1 and 2. As shown in FIG. 3, the base 100 includes a cylindrical upper body portion 102, a key 106, and a lower body portion 104, having openings 106 and 108. FIG. 3 also illustrates the cylindrical opening 302 that is centrally located in the base 100, which results in the cylindrical upper body portion to be shaped as an annulus. FIG. 4 is an isometric top view of the base 100 illustrated in FIGS. 1-3. The base 100 includes the centrally disposed cylindrical opening 302 in the base 100 that causes the base 100 to be shaped as an annulus. The cylindrical opening 302 only extends through the cylindrical upper body portion 102 and stops at the point where the lower body portion 104 is secured to the cylindrical upper body portion 102.

Figure 5:
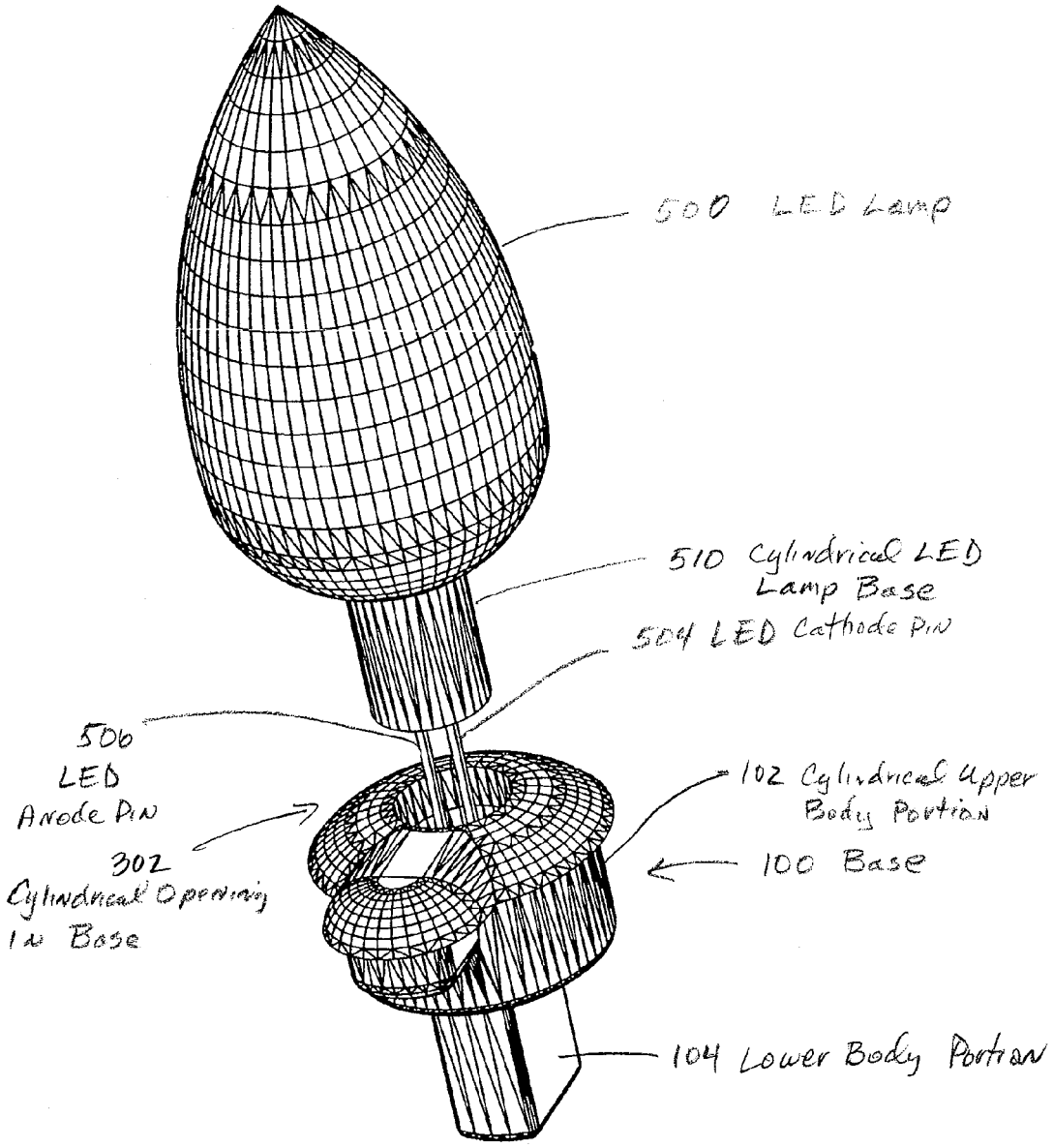
FIG. 5 is an isometric view of the base illustrated in FIG. 1, together with an LED lamp.

FIG. 5 is an isometric view of the base 100 illustrated in FIGS. 1-4 being assembled to an LED lamp 500. As shown in FIG. 5, the LED lamp 500 has a cylindrical LED lamp base 510 that fits into the cylindrical opening 302 in base 100. LED cathode pin 504 and LED anode pin 506 are inserted in and through the cylindrical opening 302 in the base 100, and protrude through openings 106, 108, respectively, in the bottom of the cylindrical LED lamp base 510. During assembly of the LED lamp 500 with the base 100, the LED anode lead 506 is aligned with the key 106 in the base 100. The cylindrical LED lamp base 510 has a length that substantially matches the length of the cylindrical upper body portion 102 of the base 100. The bottom of the cylindrical LED lamp base 510 abuts against the top portion of the lower body portion 104 inside the cylindrical opening 302 in the base 100. In this way, the rounded portion of the LED lamp 500 abuts against the top surface of the cylindrical upper body portion 102 of the base 100. This provides a degree of sealing of the LED lamp 500 to the base 100, so that the assembly of the LED lamp 500 and the base 100 is at least water resistant. In addition, the cylindrical LED lamp base 510 fits tightly within the cylindrical opening 302 to provide further water resistance.

Figure 6:
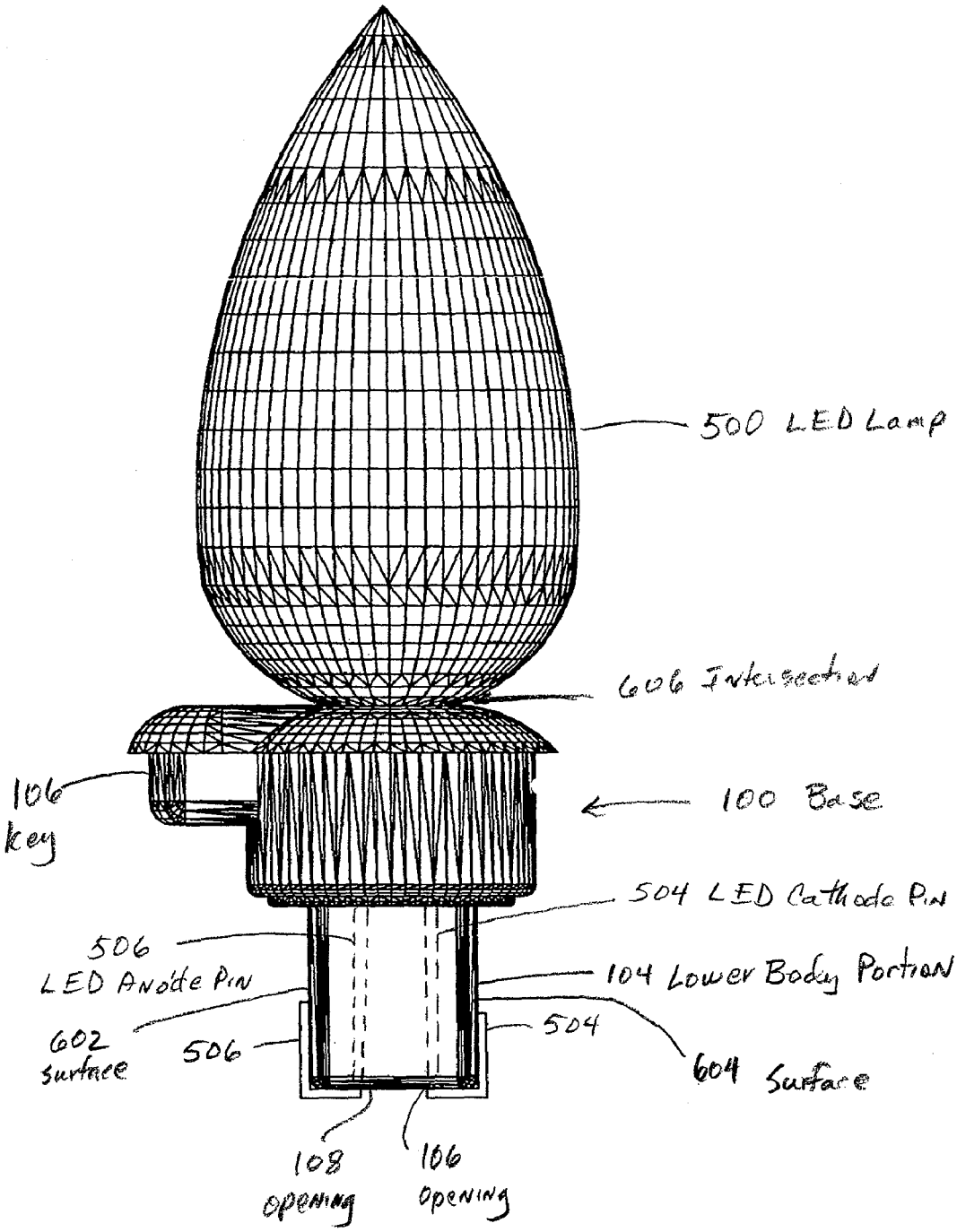
FIG. 6 is a side view of an LED lamp assembled to the base illustrated in FIG. 1.

FIG. 6 is a side view of the LED lamp 500 which is mounted to the base 100. As shown in FIG. 6, the LED anode pin 506 extends through the open area in the lower body portion 104 and protrudes through opening 108. The LED anode pin 506 is then wrapped around the base of the lower body portion 104 and surface 602 on the lower body portion 104. Similarly, LED cathode pin 504 extends through the open area in the lower body portion 104 and through the opening 106 at the base of the lower body portion 104. The LED cathode pin then wraps around the base of the lower body portion 104 and along the surface 604 of the lower body portion 104. The manner in which the LED anode pin 506 and the LED cathode pine 504 are wrapped around the outer surface of the lower body portion 104 assists in holding the LED lamp 500 in the base 100. The LED anode pin 506 is aligned with the key 106 in the base 100. In addition, as mentioned above, the intersection 606 of the LED lamp 500 and the base 100 at least partially seals the LED lamp 500 to the base 100, together with the tight fit of the cylindrical LED lamp base 510 to the cylindrical opening 302 in the base 100, as shown in FIG. 5.

Figure 7:
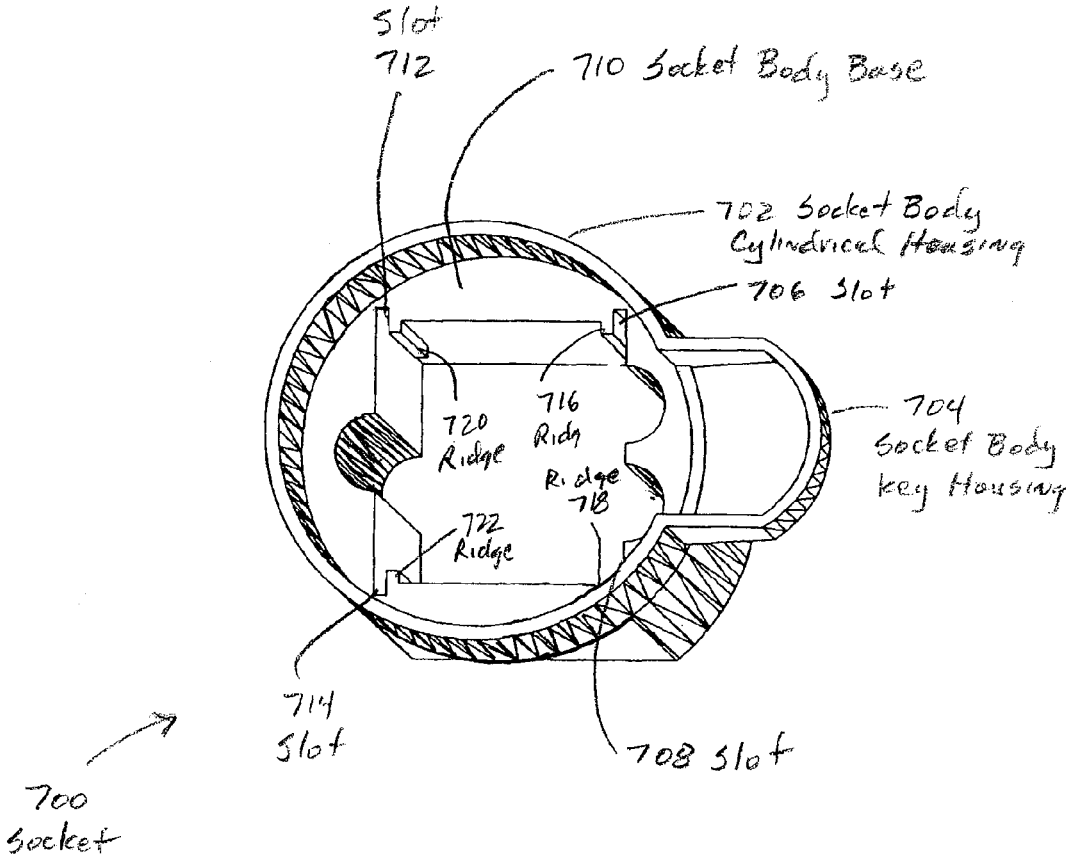
FIG. 7 is a top isometric view of one embodiment of a socket body base.

FIG. 7 is a top isometric view of one embodiment of a socket 700. Socket 700 includes a socket body cylindrical housing 702, which is attached to a socket body base 710. A socket body key housing 704 is attached to the socket body cylindrical housing 702. The socket body cylindrical housing 702 has a shape that allows the cylindrical upper body portion 102 to fit within and seal the base 100 to the socket 700.

Similarly, the key 106 fits and is sealed to the socket body key housing 704. The socket body base may be formed in a rectangular configuration as shown in FIG. 7, or other configurations. Slots 706 and 708 are formed along one wall of the rectangular configuration, while slots 712 and 714 are configured along another wall of the rectangular socket body base 710. Ridges 716, 718 are disposed adjacent slots 706, 708, respectively. Similarly, ridges 720, 722 are disposed adjacent slots 712, 714, respectively. These slots 706-714 and the adjacent ridges 716-722 only extend a portion of the length of the socket body base 710.

Figure 8:
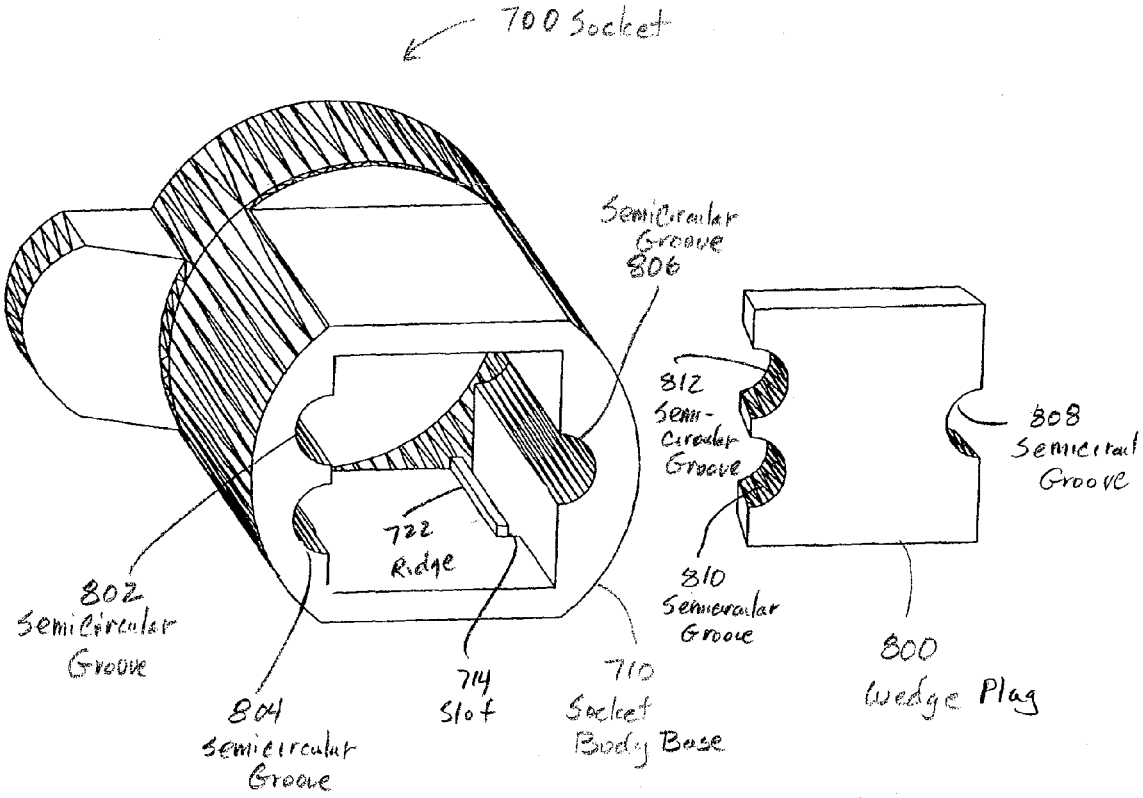
FIG. 8 is a bottom isometric view of the socket body base illustrated in FIG. 7, together with a wedge.

FIG. 8 is an isometric bottom view of the socket 700 illustrated in FIG. 7, together with a wedge plug 800. As shown in FIG. 8, semicircular groove 802 and semicircular groove 804 are formed in a first wall of the socket body base 710. A semicircular groove 806 is formed on an opposing wall of the socket body base 710. FIG. 8 also illustrates the ridge 722 and associated slot 714 that only extend a portion of the length of the socket body base 710, which may form an abutment surface for the wedge plug 800 when inserted in the opening in the socket body base 710. The wedge plug 800 includes a single semicircular groove 808 on one side of the wedge plug 800 and semicircular grooves 810, 812 on an opposite of the wedge plug 800. Semicircular groove 808 matches up with semicircular groove 806 while semicircular grooves 810, 812 match up with semicircular grooves 804, 802, respectively, when the wedge plug 800 is inserted into the socket body base 710. In this manner, circular openings are formed for the passage of wires for connecting the lamp assembly to a power supply.

Figure 9:
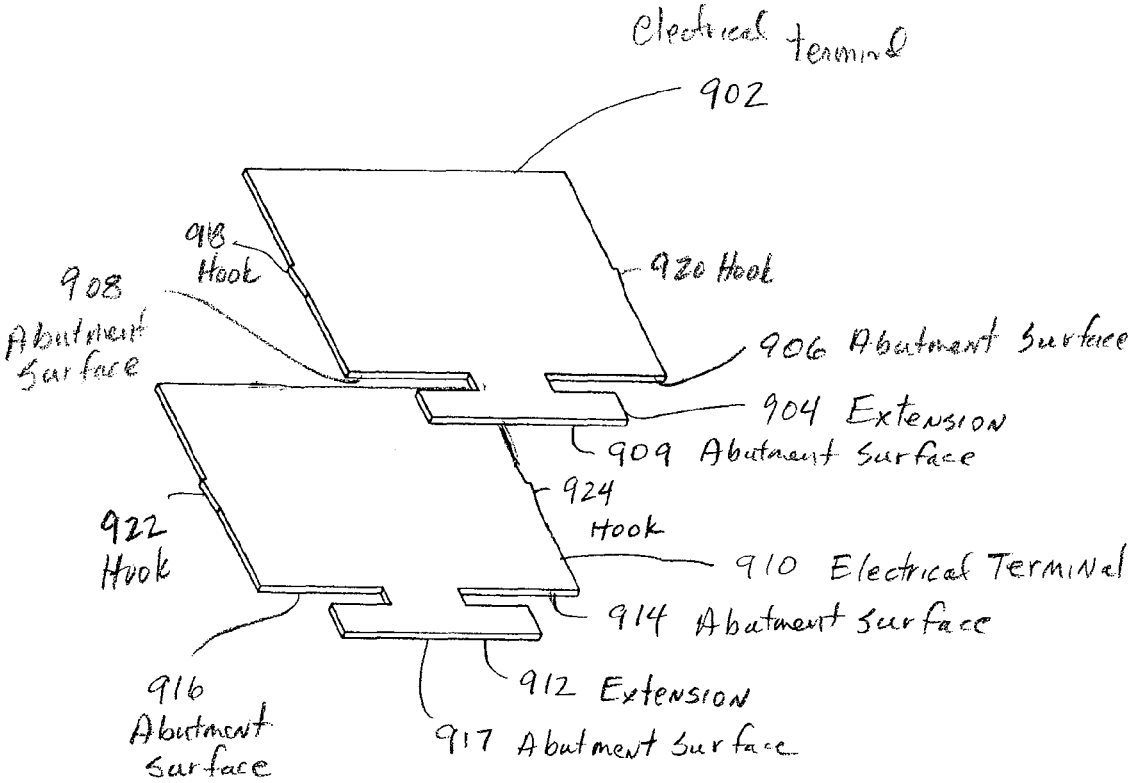
FIG. 9 is an isometric view of one embodiment of two electrical terminals.

FIG. 9 is an isometric view of electrical terminal 902 and electrical terminal 910. Electrical terminal 902 includes an extension 904 having an abutment surface 909. The main body of the electrical terminal 902 has abutment services 906, 908. Similarly, electrical terminal 910 has an extension 912 having an abutment service 917. The main body portion of the electrical terminal 910 includes abutment surfaces 914, 916. Electrical terminal 902 also has hooks 918, 920 along a side edge. Similarly, hooks 922, 924 dispose along side edges of the electrical terminal 910. These hooks function to hold the electrical terminals 902, 910 in position in the slots in the socket body base 710.

Figure 10:
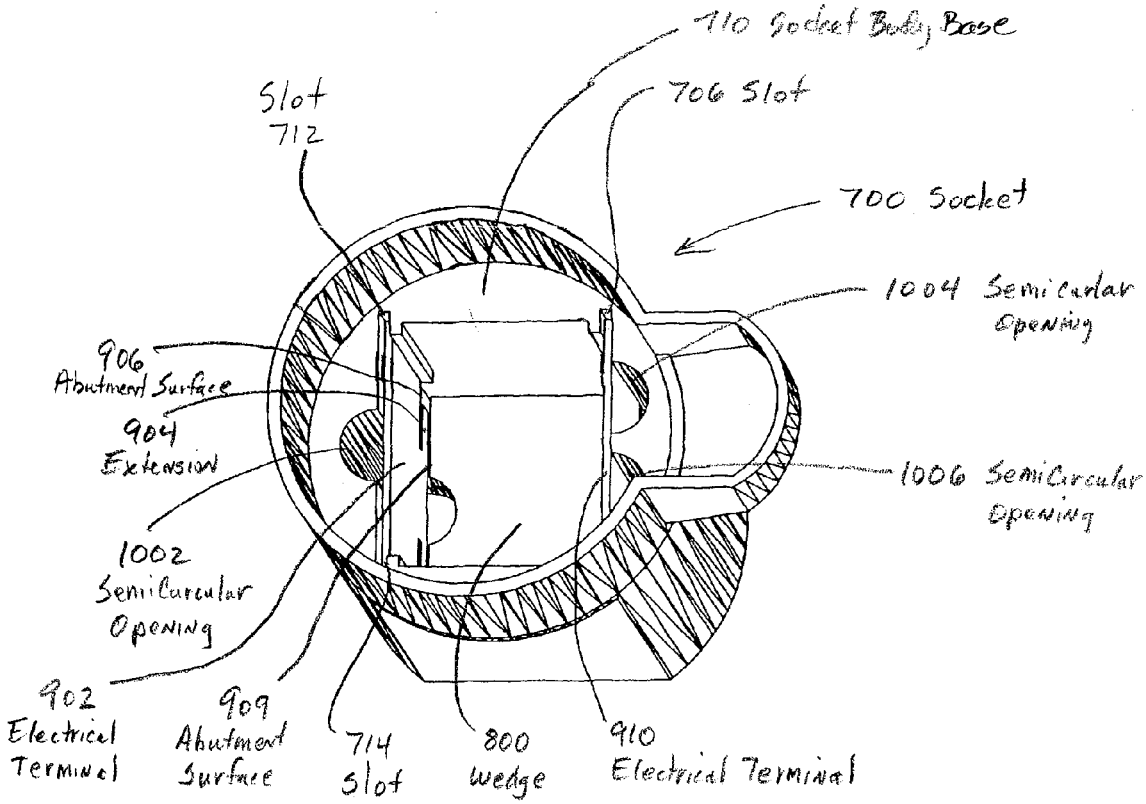
FIG. 10 is a top isometric view of the embodiment of a socket illustrated in FIG. 7.
Figure 13:
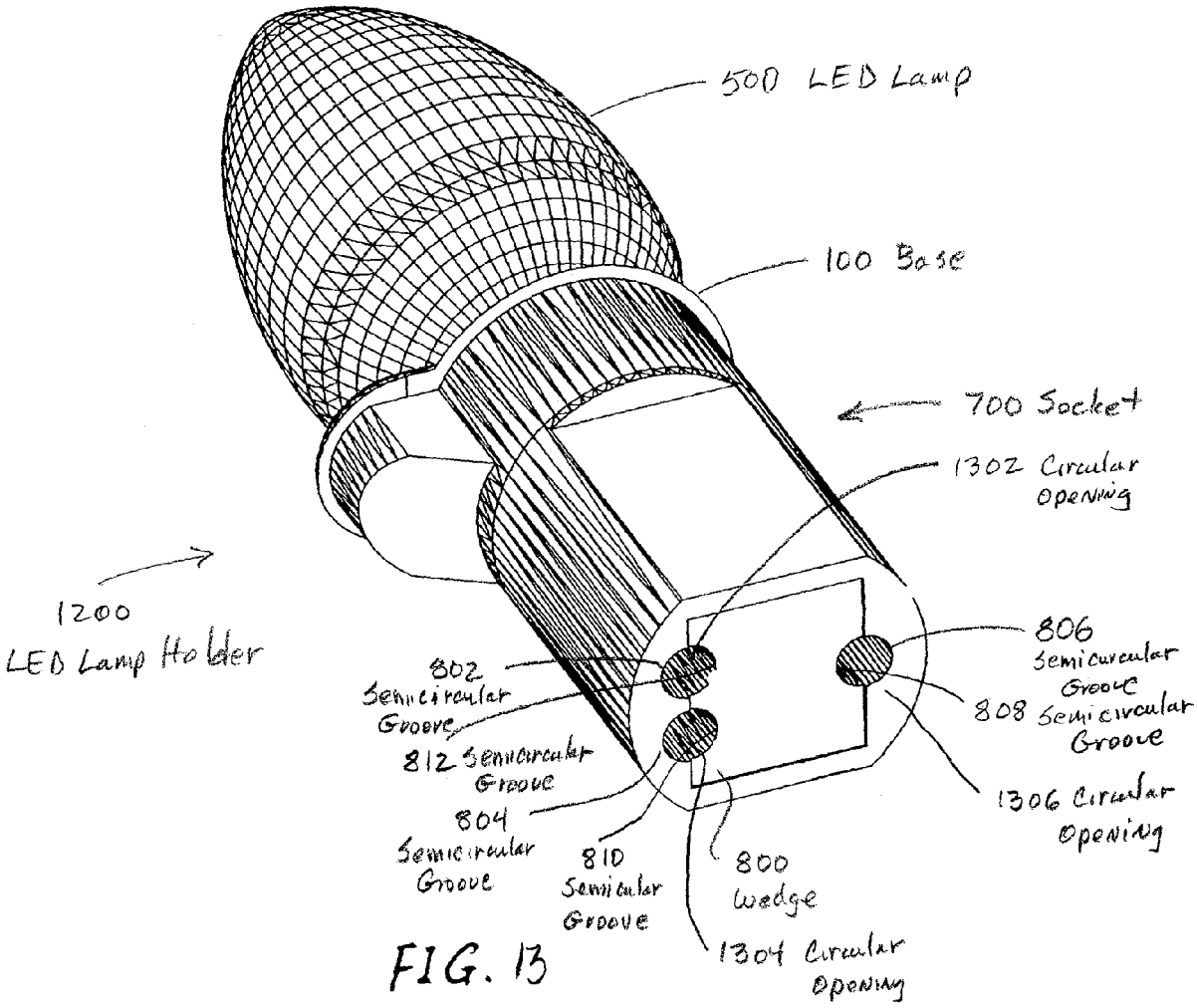
FIG. 13 is an isometric bottom view of the LED lamp assembled in one embodiment of an LED lamp holder comprising the base illustrated in FIG. 1 and the socket illustrated in FIG. 7.

FIG. 10 is a top isometric view of the socket 700. As shown in FIG. 10, electrical terminal 902 is inserted in slots 712, 714 formed in the socket body base 710. Abutment surface 906 and abutment surface 908 (FIG. 9) abut against the bend of the slots 712, 714, respectively. The extension 904 extends beyond the abutment surface 906 and has an abutment surface 909 which abuts against the wedge 800. The extension 904 allows the wedge to be inserted in the rectangular opening of the socket body base 710 to a point where it is flush with the bottom of the socket body base 710 as illustrated in FIG. 13. Electrical terminal 910 is inserted in slots 706, 708 similarly to electrical terminal 902. The semicircular opening 1002 is enclosed by the electrical terminal 902 as illustrated in FIG. 10. A wire inserted from the bottom of the socket body base 710 through the semicircular opening in the wedge 800 is held in the semicircular opening 1002 by the electrical terminal 902. The wire (not shown) exerts an inward force on the electrical terminal 902 towards the inner portion of the rectangular opening in the socket body base 710. Similarly, wires inserted in the semicircular opening 1004, 1006 are held in place by electrical terminal 910. The wires 1402-1406 (FIG. 14) generate an inward force on the electrical terminal 910 towards the interior of the rectangular opening in the socket body base 710.

Figure 11:
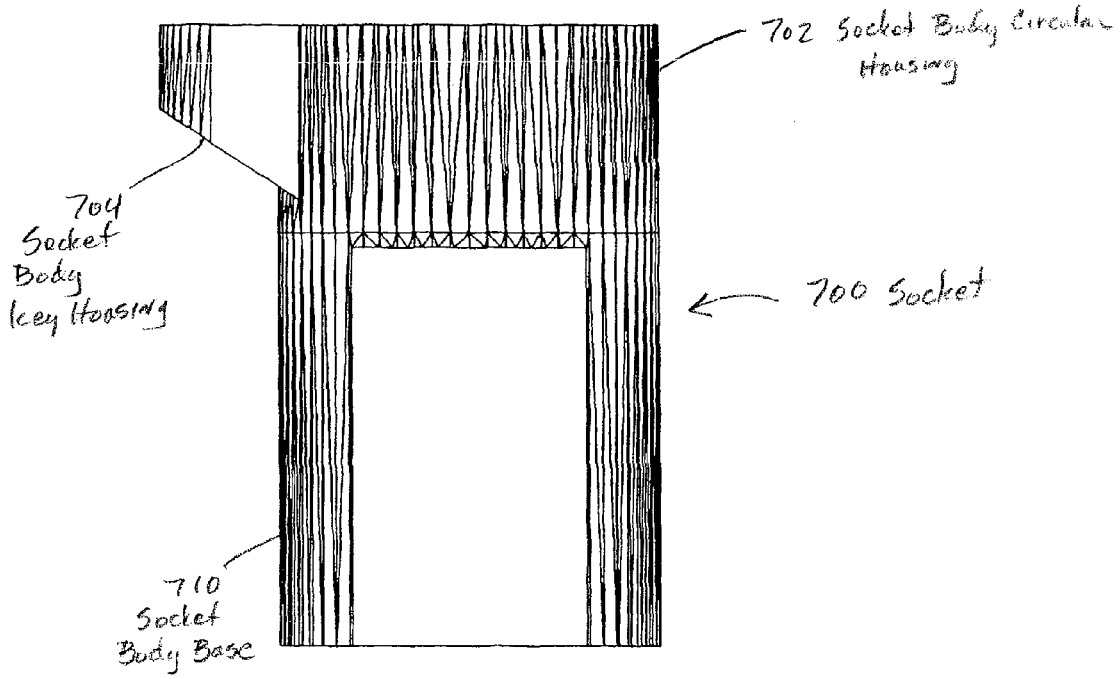
FIG. 11 is a side view of the socket illustrated in FIG. 7.

FIG. 11 is a side view of the socket 700. The socket 700 includes a socket body base 710, a socket body circular housing 702 and a socket body key housing 704. The socket 700 is made from a single, molded piece of plastic.

Figure 12:
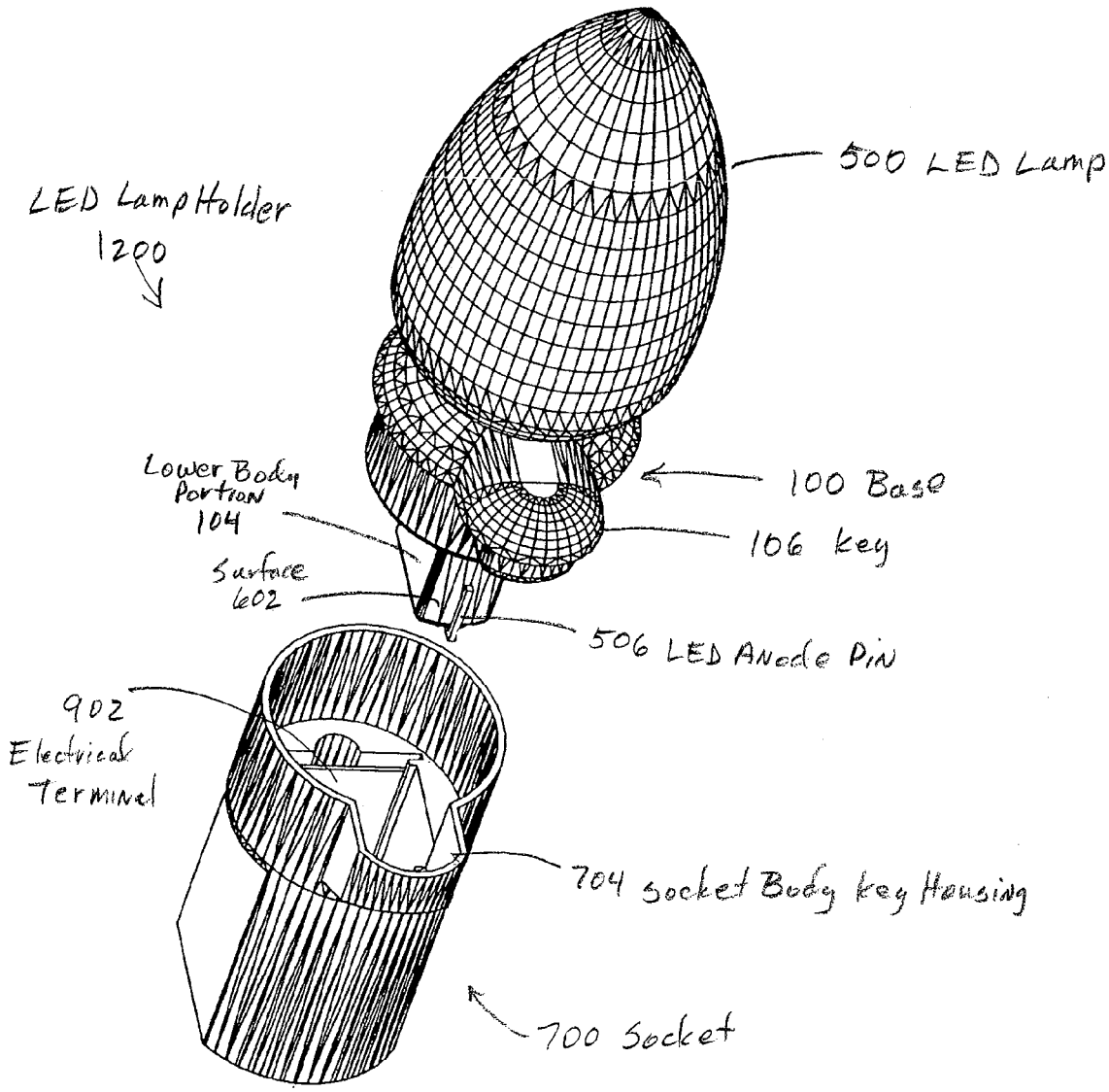
FIG. 12 is a top isometric view of an assembled LED lamp and base that is being assembled to the socket illustrated in FIG. 7.

FIG. 12 is an isometric assembly view of an LED lamp holder 1200. As shown in FIG. 12, the LED lamp 500 is assembled to the base 100. LED anode pin 506 is wrapped around a surface 1202 of the lower body portion 104. Electrical terminals such as electrical terminal 902 are inserted into the socket 700. The base 100 is then inserted into the socket 700 so that the key 106 is aligned with the socket body key housing 704 for proper orientation and alignment of the base 100 to the socket 700. The LED anode pin 506 and the lower body portion 104 exert an outward force on electrical terminal 910 (FIG. 10). This outward force is countered by an inward force created by wires disposed in semicircular openings 1004, 1006 (FIG. 10). An LED cathode pin (FIG. 6) is wrapped around surface 604 (FIG. 6). Surface 604 and the LED cathode pin 504 exert a force on electrical terminal 902 which is offset by a force created by a wire disposed in the semicircular opening 1002 (FIG. 10), which is created in a substantially opposite direction. The forces created on the electrical terminals 902, 910 in substantially opposite directions create a strong electrical connection between the LED anode pin 506 and the electrical terminal 910, as well as the LED cathode pin 504 and the electrical terminal 902. These forces, however, still allow the base 100 to be inserted into the socket 700 and to be removed from the socket 700 for replacement of the LED lamp 500. The LED lamp 500 can be replaced by unwrapping the LED cathode pin 504 from surface 604 and the LED anode pin 506 from surface 602 so that the LED cathode pin 504 and the LED anode pin 506 can be straightened and removed from the openings 106, 108, respectively, as shown in FIG. 6. A friction fit between the interior surface of the socket body cylindrical housing 702 (FIG. 7) and the outer surface of the cylindrical upper body portion 102 (FIG. 5) seals the base 100 to the socket 700, prevents water from entering the socket 700 and maintains the structural integrity of the assembled LED lamp holder 1200.

FIG. 13 is an isometric view of the assembled LED lamp holder 1200. As shown in FIG. 13, the LED lamp 500 is secured to the base 100. The socket 700 is also secured to the base 100. The wedge 800 is secured in the bottom of the socket 700. The semicircular groove 812 of the wedge 800 matches the semicircular groove 802 of the socket to form a circular opening 1302. Similarly, the semicircular groove 810 of the wedge 800 matches the semicircular groove 804 of the socket 700 to form a circular opening 1304. Semicircular groove 808 of the wedge 800 matches the semicircular groove 806 of the socket 700 to create a circular opening 1306. Wires (not shown) extend through the circular openings 1302, 1304, 1306 and are held securely by the socket 700 and wedge 800 to resist removal. Wedge 800 can be friction fit into the base of the socket 700, or it can be adhesively attached, heat welded or otherwise welded into the socket 700.

Figure 14:
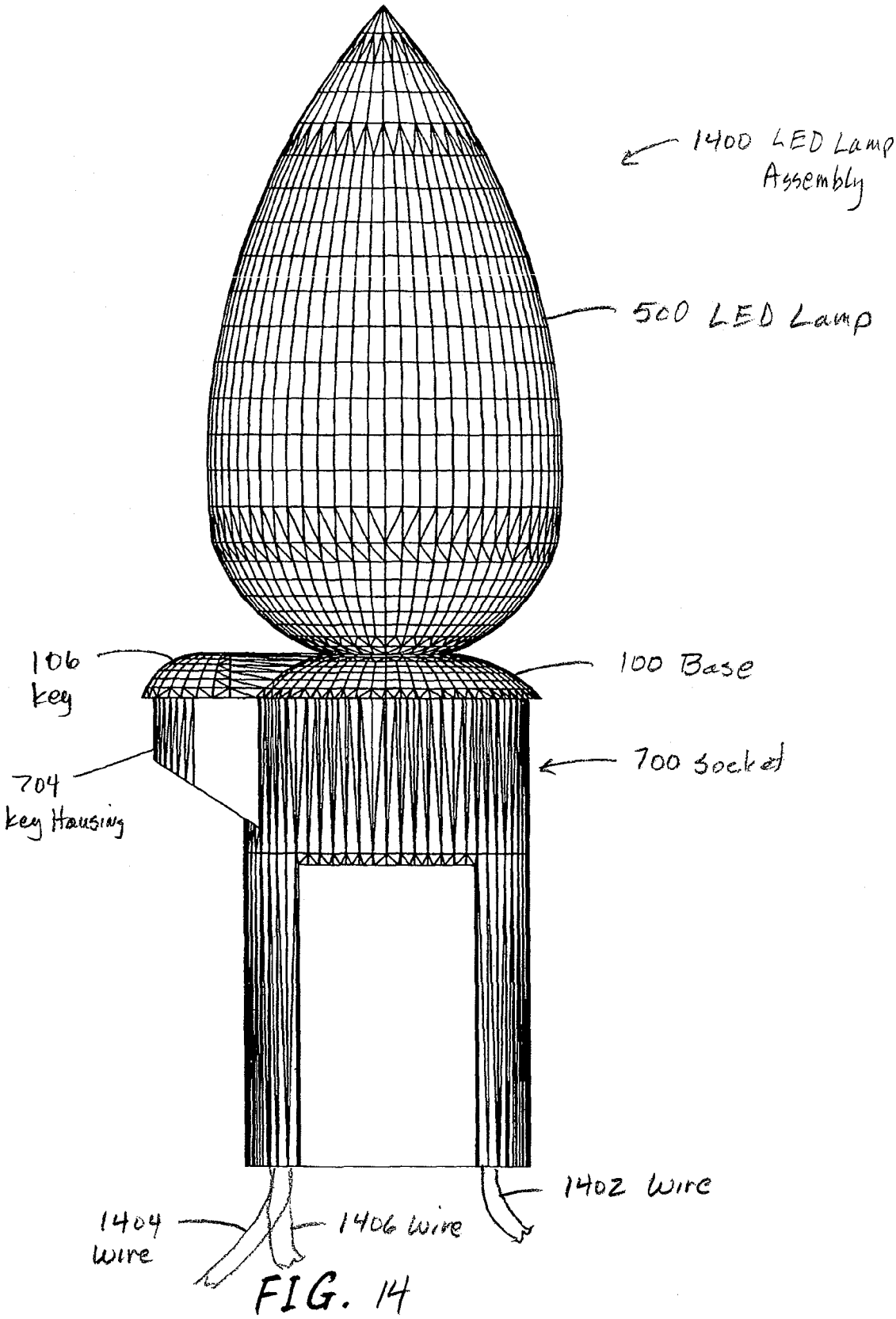
FIG. 14 is a side view of the embodiment illustrated in FIG. 13.

FIG. 14 is a side view of the LED lamp assembly 1400. The LED lamp assembly 1400 includes an LED lamp 500, a base 100 that includes a key 106, a socket 700 having a key housing 704 and wires 1404, 1406, 1402 that are secured in the socket 700 by wedge 800 (FIG. 13). The LED lamp assembly 1400 can be connected in a parallel configuration such that wires 1404, 1406 are both connected to a power source. Wire 1402 is connected to the next LED lamp.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. An LED lamp assembly for releasably attaching an LED lamp to a power connection comprising:

an LED lamp comprising:

a rounded upper body lamp portion;

a cylindrical lamp base;

an anode pin and a cathode pin extending from said cylindrical lamp base;

a base comprising a lower body connected to said cylindrical lamp base, said lower body having a first opening formed in said lower body through which said anode pin protrudes and wraps around a first surface of said lower body, and a second opening formed in said lower body through which cathode pin protrudes and wraps around a second surface of said lower body;

a socket comprising a socket body base formed to provide a socket body opening with two semicircular grooves formed in a first wall of said socket body opening, and one semicircular groove formed in a second wall, a first set of slots disposed adjacent to said first wall of said socket body opening that extend a portion of a length of said socket body base, and a second set of slots disposed adjacent to said second wall of said socket body opening that extend a portion of a length of said socket body base;

an anode terminal plate disposed in said first set of slots that contacts said anode pin that is sandwiched between said anode terminal plate and said first surface of said lower body, so that an electrical contact is formed between said anode terminal plate and said anode pin without soldering said anode pin to said anode terminal plate;

a cathode terminal plate disposed in said second set of slots that contacts said cathode pin that is sandwiched between said cathode terminal plate and said second surface of said lower body, so that an electrical contact is formed between said cathode terminal plate and said cathode pin without attaching said cathode pin to said terminal plate;

a first pair of wires sandwiched between said two semicircular grooves formed in said first wall and said anode terminal plate, said wires having a size that is sufficient to create a force on said anode terminal plate towards said anode pin, and said anode pin and said lower body having a size sufficient to create a force on said anode terminal plate towards said wires so that said pair of wires and said anode pin are forced in substantially opposite directions against said anode terminal plate to create a solid electrical connection of said first pair of wires and said anode pin to said anode plate without soldering said wires and said anode pin to said anode plate, while allowing said lower body portion to be removed from said socket;

a third wire sandwiched between said semicircular groove formed in said second wall and said cathode terminal plate, said third wire having a size that is sufficiently large to create a force on said cathode terminal plate towards said cathode pin, and said cathode pin and said lower body having a size sufficient to create a force on said cathode terminal plate towards said third wire so that said third wire and said cathode are pin forced in substantially opposite directions against said cathode terminal plate to create a solid electrical connection of said third wire and said cathode pin to said cathode plate without soldering said third wire and said cathode pin to said cathode plate, while allowing said lower body portion to be removed from said socket;

a wedge plug having two semicircular grooves formed in a first wall of said wedge plug and one semicircular groove formed in a second wall of said wedge plug so that when said wedge plug is inserted in said socket body base, said two semicircular grooves formed in said wedge plug are aligned with said two semicircular grooves formed in said socket body base to form two circular openings, and said one semicircular groove formed in said wedge plug is aligned with said one semicircular groove formed in said socket body base to form one circular opening, said two circular openings having a size that locks and seals said first pair of wires in said socket body base, and said one circular opening having a size that locks and seals said third wire in said socket body base.

2. The LED lamp assembly of claim 1 wherein said base further comprises:

a cylindrical upper body that is formed in an annulus with a centrally disposed cylindrical opening, in which said cylindrical lamp base is disposed, so that a seal is created between said rounded upper body lamp portion and said annulus and said cylindrical lamp base and said centrally disposed cylindrical opening.

3. The LED lamp assembly of claim 2 wherein said socket further comprises:

a socket body cylindrical housing that has a size that creates a friction fit and a substantially watertight seal with said cylindrical upper body portion of said base.

4. The LED lamp assembly of claim 3 further comprising:

a protrusion extending from said cylindrical upper body portion that forms a key;

a key housing disposed on said socket when said key is disposed.

5. The LED lamp assembly of claim 1 further comprising:

plate abutment surfaces disposed on said anode terminal plate and said cathode terminal plate that are substantially aligned with abutment surfaces in said slots;

a wedge plug abutment surface that abuts against extensions of said anode terminal plate and said cathode terminal plate.

6. A method of releasably connecting an LED lamp to an AC power string and to other LED lamps comprising:

providing a lamp holder comprising a base, a socket body, an anode terminal plate, a cathode terminal plate and a wedge plug;

providing an LED lamp that has a cylindrical lamp base, an anode pin and a cathode pin;

inserting said LED lamp into said base of said lamp holder to form a seal between said base and said LED lamp;

inserting said anode pin and said cathode pin through openings in said base;

wrapping said anode pin around a first surface of said base so that said anode pin can be removed from said base to replace said LED lamp;

wrapping said cathode pin around a second surface of said base so that said cathode pin can be removed from said base to replace said LED lamp;

inserting a first pair of wires in first and second semicircular grooves in said socket body of said lamp holder;

inserting said anode terminal plate into a first set of slots adjacent to said first and second semicircular grooves so that said first pair of wires are sandwiches between said first and second semicircular grooves and said anode terminal plate which creates an inward force on said anode terminal plates;

inserting a third wire in a third semicircular groove in said socket body of said lamp holder;

inserting said cathode terminal plate into a second set of slots adjacent to said third semicircular groove so that said third wire is sandwiched between said third semicircular groove and said cathode terminal plate which creates an inward force on said cathode terminal plate;

inserting said base into said socket body, said base having a size that creates an outward force from said first surface of said base towards said anode terminal plate and from said second surface of said base towards said cathode terminal plate so that said anode pin and said first pair of wires are forced in substantially opposite directions against said anode terminal plate to create a strong electrical connection while allowing said base and said anode pin to be removed from said socket body, and said cathode pin and said third wire are forced in substantially opposite directions against said cathode terminal plate to create a strong electrical connection while allowing said base and said cathode pin to be removed from said socket body;

inserting a wedge plug in said socket body, said wedge plug having semicircular grooves that are aligned with said first, second and third semicircular grooves in said socket body to form circular openings that have a size that locks and seals said wires to said socket body.

* * * * *